350-332 SR
12/30/86 XR 4,633,242

United States Patent [19]
Sekiya

[11] Patent Number: 4,633,242
[45] Date of Patent: Dec. 30, 1986

[54] ROW CONDUCTOR SCANNING DRIVE CIRCUIT FOR MATRIX DISPLAY PANEL

[75] Inventor: Fukuo Sekiya, Tokorozawa, Japan

[73] Assignee: Citizen Watch Company Limited, Tokyo, Japan

[21] Appl. No.: 558,089

[22] Filed: Dec. 5, 1983

[30] Foreign Application Priority Data

Dec. 17, 1982 [JP] Japan ..... 57-220048

[51] Int. Cl.[4] ..... G09G 3/02
[52] U.S. Cl. ..... 340/719; 340/718; 340/784; 340/800; 340/811; 350/332
[58] Field of Search ..... 340/718, 719, 763, 765, 340/783, 784, 789, 800, 801, 811; 350/332, 333

[56] References Cited

U.S. PATENT DOCUMENTS 4,368,523 1/1983 Kawate ..... 340/784
4,481,511 11/1984 Hanmura et al. ..... 340/765

FOREIGN PATENT DOCUMENTS 2080593 2/1982 United Kingdom ..... 340/765

OTHER PUBLICATIONS

"A Liquid-Crystal TV Display Panel Using a MOS Array with Gate-Bus Drivers", Kasahara et al, Conference Record, Cherry Hill, N.J. (21-23 Oct. 1980).

*Primary Examiner*—Gerald L. Brigance
*Assistant Examiner*—Jeffery A. Brier
*Attorney, Agent, or Firm*—Jordan and Hamburg

[57] ABSTRACT

A row conductor drive circuit for a matrix display device, to be formed directly upon one substrate of a display panel, is divided into a number of circuit sections connected in series each comprising at least two shift registers. Only one shift register in a circuit section is made operable to produce row conductor scanning signals, the operable shift register being selected based on testing performed after manufacture and with shift registers being selectively set in the operable or non-operable states by potentials applied to control terminals provided in the circuit sections. A set of properly operating shift registers are thereby effectively connected in series to produce row conductor scanning signals even if some shift registers of the circuit sections are defective. Manufacturing yield of the display device is thereby substantially increased.

4 Claims, 7 Drawing Figures

4
6
MSK
SET
φ
X1
X2
S
Q
R
D
Q1
Q2
Qn
φ
18
16
14
8A
8B
30
28
26
40
24
32a
32b
34
36a
36b
36n
C
Tr
22a
22b
22n
20a
20b
21
Y1
Y2
Yn

ROW CONDUCTOR SCANNING DRIVE CIRCUIT FOR MATRIX DISPLAY PANEL

BACKGROUND OF THE INVENTION

The present invention relates to a row conductor drive circuit for a matrix display device, and in particular to a row conductor drive circuit for an "active matrix" type of matrix display device in which each picture element of the display is controlled by an individual control element, i.e. a thin-film transistor, and in which the row conductor drive circuit is formed directly upon the same substrate of a display panel of the matrix display device as these control transistors.

The "active matrix" type of matrix display device is becoming widely used, generally as a liquid crystal type of display device, and has shown suitability for providing matrix displays of extremely small size, such as are required for wrist-watch television receivers. With such a display device, a plurality of row conductors and a plurality of column conductors are formed upon a panel of the display, insulated from one another at their intersections, with a transistor coupled to a capacitor being formed at each of these intersections. The gate electrode of each transistor is coupled to the corresponding row conductor, and when that row conductor is selected by being set to a predetermined potential by a row scanning signal, a signal level representing picture data is transferred through the transistor and stored as a charge on the capacitor. The resultant capacitor potential determines the visual state of a corresponding picture element.

In the case of such a very small size of display device, greater compactness can be achieved by forming the row drive circuit (i.e. the circuit which generates row scanning signals to successively select the row conductors of the matrix) directly upon the same display panel as that on which the control transistors and row conductors and column conductors are formed. Such a row conductor drive circuit generally comprises a shift register, with each shift register stage output being coupled to a corresponding one of the row conductors, and with the shift register outputs successively producing the row scanning signals (e.g. in the case of a television display, scanning all of the row conductors during each period of the vertical sync pulse signal).

A problem which arises with regard to the practical manufacture of a matrix display device provided with such a row conductor drive circuit is that if a single shift register stage should be defective, then the entire row conductor drive circuit (and hence the entire matrix display device) is unusable. As a result of this, the manufacturing yield is comparatively low, thereby tending to increase the cost of manufacture of such a matrix display device.

One method which has been proposed in the prior art, and proposed in Japanese Pat. No. 56-104388, is to utilize a pair of shift register effectively connected in parallel to the row conductors, i.e. respectively formed on the right hand and left hand sides of the display panel, and select one of these shift registers to be used as the row conductor drive circuit after it has been confirmed to be functioning correctly. Such a method will enable a certain degree of improvement in the manufacturing yield, but since it is still necessary that at least one of these two shift registers (each made up of, for example, 210 stages connected in series) must be operating correctly, only a relatively small improvement in the yield can be expected.

There is therefore a requirement for a row conductor drive circuit for a matrix display device of the type described above, which will enable a substantially greater improvement to be made in the manufacturing yield of such devices, and to thereby render their application more practical.

SUMMARY OF THE INVENTION

A row conductor drive circuit for a matrix display device according to the present invention is designed to overcome the problems of low manufacturing yield which have arisen in the prior art as described above, whereby the effective manufacturing yield can be increased to a substantial degree, with a simple circuit configuration. A row conductor drive circuit according to the present invention essentially comprises a plurality of row conductor drive circuit sections, each comprising at least a first and a second shift register provided with respective control terminals, and a monitor terminal. Corresponding pairs of outputs of the first and second shift registers of a row conductor drive circuit section (e.g. the first stage outputs, the second stage outputs, ect) each can be coupled to a corresponding row conductor of the matrix display device, but only either one of the first and second shift registers in row conductor drive circuit section are enabled to apply row scanning signals to the row conductors. The monitor terminal of a row conductor drive circuit section is used to monitor the operation of the shift register in that section which is currently enabled to apply row scanning signals. If a potential is attained by the monitor terminal indicating that the operation of that enabled shift register is defective, then that shift register is thereafter disenabled and the other shift register of that row conductor drive circuit section is enabled to apply row scanning signals. The final stage output signal from each row conductor drive circuit section is applied as a data signal to initiate shift register operation of the next row conductor drive circuit section.

In this way, so long as at least one of the shift registers in each row conductor drive circuit section is functioning correctly, then a complete row scanning sequence can always be attained. It can thus be understood that the possibility of complete row conductor drive circuit defectiveness can be decreased, and hence the manufacturing yield increased as much as desired, by increasing the number of row conductor drive circuit sections.

The monitor operation can be implemented in a very simple manner, i.e. by detecting whether a row scanning signal is output from the final stage of the currently enabled shift register of that row conductor drive circuit section. If no such signal is produced, then this indicates that the shift register is defective, whereupon that shift register can be made inoperative, and operation of the other shift register of that row conductor drive circuit section enabled, to thereby ensure correct scanning operation by that row conductor drive circuit section so long as at least one shift register in the circuit section is operating correctly.

Selective enabling and disenabling of application of row scanning signals from shift registers by the monitor circuits can be implemented by selectively applying power to or cutting power off from the shift registers, or by providing electronic switches controlled to selectively connect and disconnect the shift register outputs and the row conductors, or by a combination of these methods.

DESCRIPTION OF THE PREFERRED EMBODIMENTS

Figure 1:
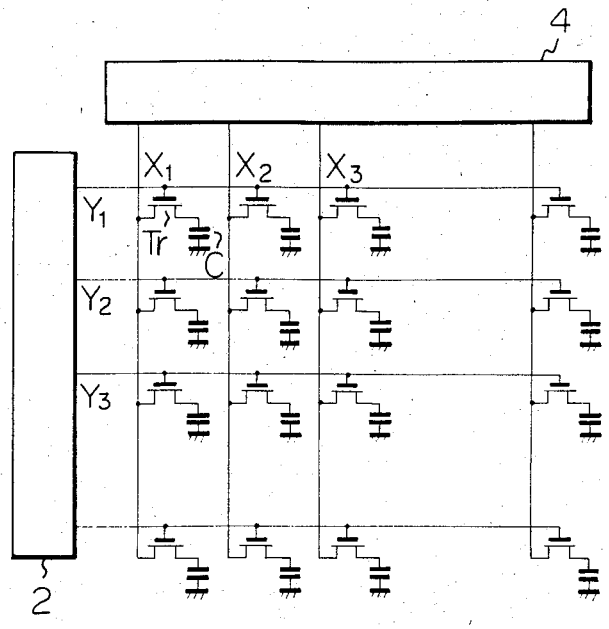
FIG. 1 is a simplified circuit diagram for assistance in describing a general type of matrix display device.

FIG. 1 shows the general configuration of a matrix display device of the "active matrix" type. Numeral 2 denotes a row conductor drive circuit and numeral 4 a column conductor drive circuit. The row conductor drive circuit 2 produces row conductor scanning signals which are successively applied to row conductors Y1, Y2, Y3 . . . , which are formed on a display panel together with a set of column conductors designated as X1, X2, X3, . . . . While each of row conductors Y1, Y2, . . . is in the selected state (i.e. with a scanning signal at a predetermined potential applied thereto) image data signals are output from column conductor drive circuit 4, generally being produced successively on each of the column conductors while a row conductor is in the selected state. A control element, i.e. a transistor designated as Tr is formed at each intersection of the row conductors and column conductors, with the gate electrode thereof coupled to the corresponding row conductor and with drain and source electrodes connected in series between the corresponding column conductor and one terminal of a capacitor C. Thus, when a row conductor, e.g. Y1 is selected by a row scanning signal, and data is applied on a column conductor, e.g. X1, then the transistor at the intersection of conductors X1 and Y1 is made conductive and hence transfers the data signal potential to be stored as a charge on capacitor C. The potential appearing across capacitor C determines the state of lightness or darkness of a corresponding picture element of the display.

Generally, the row conductor drive circuit 2 simply consists of a shift register, with the output of each shift register stage being coupled to a corresponding one of the row conductors. Thus, if one of these shift register stages should be defective, then correct row scanning operation will not be possible. If row conductor drive circuit 2 is a separate circuit component (e.g. an integrated circuit chip) from the display panel on which the column conductors and row conductors are formed, then this does not present a major problem, since it may be possible to produce such a row conductor drive circuit at relatively low cost even if the manufacturing yield is not high. However if a very miniaturized type of "active matrix" matrix display device is to be manufactured, then it is desirable to form the row conductor drive circuit on the same substrate (e.g. glass panel) of the matrix display device as that on which the control transistors Tr of the matrix are formed. This will simplify interconnections between the row conductor drive circuit and the control transistors, and in addition may enable the row conductor drive circuit to be formed in the same manufacturing process as the control transistors Tr. However if this is done, then if one stage of the shift register in row conductor drive circuit 2 should be defective, the entire matrix display device will be inoperable. A low manufacturing yield in such a case will result in a substantially increased manufacturing cost for the matrix display device as a whole. In order to integrate the row conductor drive circuit of such an "active matrix" matrix diaplsy device onto the display panel itself, therefore, it is necessary to ensure that the manufacturing yield will not be significantly lowered as a result of occasional defects in individual stages of the shift register constituting the row conductor drive circuit.

Figures 2, 2A, 2B, 2C:
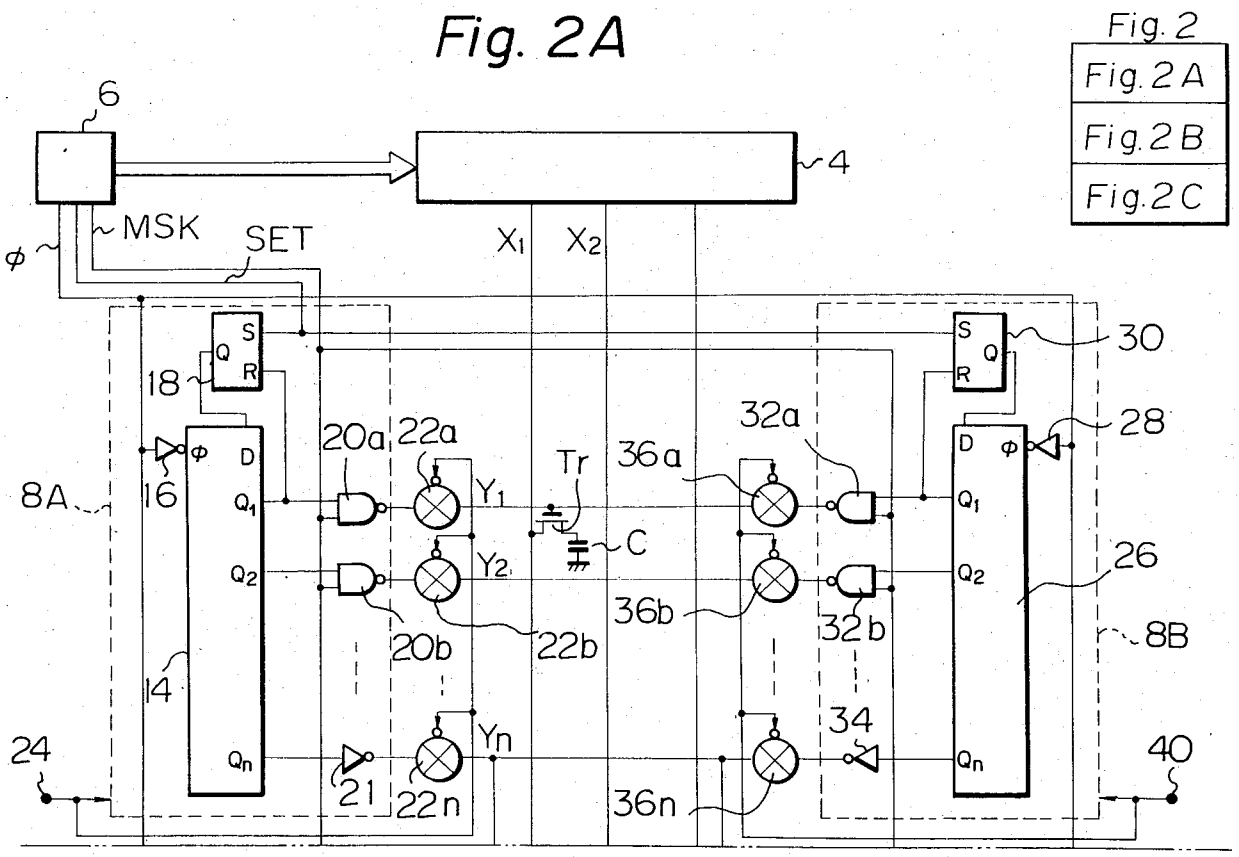
FIGS. 2A, 2B and 2C constitute a circuit diagram of an embodiment of a matrix display device incorporating a row conductor drive circuit according to the present invention.
Figure 2B:
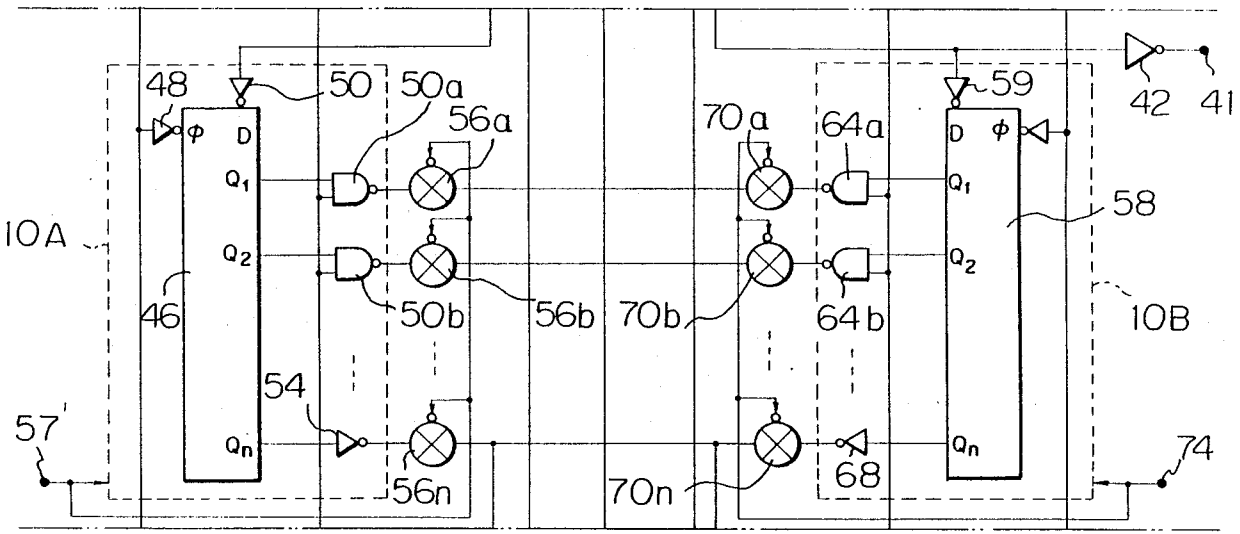
Figure 2C:
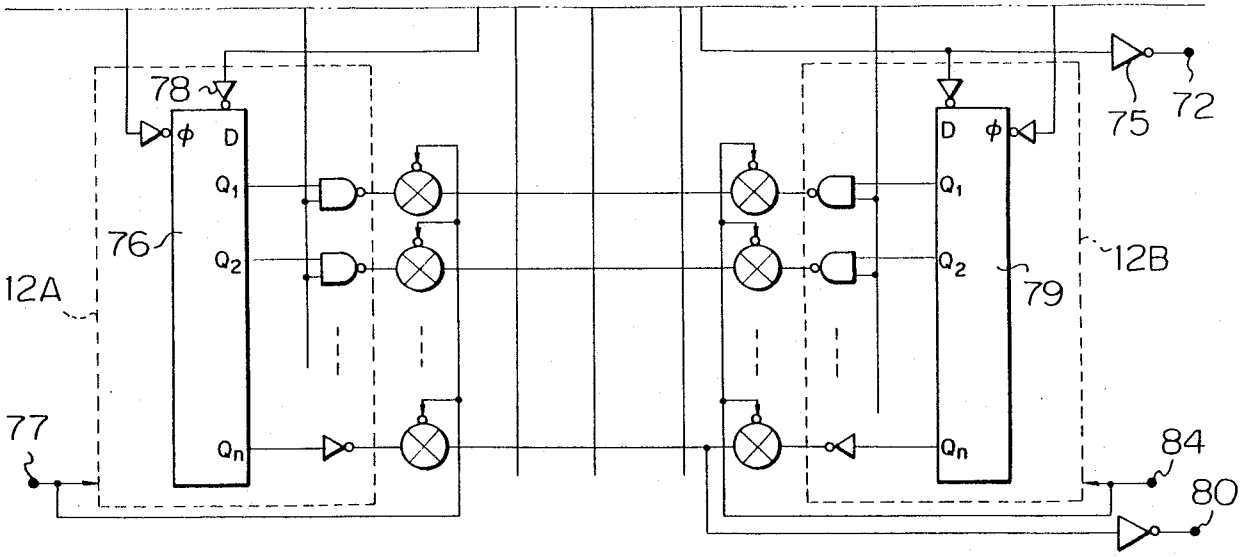

FIGS. 2A, 2B and 2C is a circuit diagram of an embodiment of a matrix display device incorporating a row conductor drive circuit according to the present invention. Numeral 6 denotes a control and timing signal generating circuit which produces various signals including a clock signal $\phi$ which determines the timing of row conductor scanning signals, a SET signal which is produced at the start of a row scanning period, i.e. is synchronized with a vertical sync signal, and a signal MSK, which acts to ensure that only one row conductor is selected at a time, by the row conductor scanning signals. Numeral 4 denotes a column conductor drive circuit, which produces data signals X1, X2, . . . representing data to be written into the picture elements of the display, at timings synchronized with those of the row conductor scanning signals. While a row conductor is in the selected state, potentials representing data to be written into the picture elements of that row are sequentially output from column conductor drive circuit 4, as signals X1, X2, . . . , and thereby transferred through a transistor Tr to be stored in a capacitor C, as in the case of the matrix display device of FIG. 1 described above.

A row conductor drive circuit for a matrix display device according to the present invention is divided into a plurality of row conductor drive circuit sections, with each of these sections including at least a first and a second shift register, and a monitor terminal for monitoring the operation of these shift registers to enable determination of which of the shift registers is to be held in an operative state, i.e. a state in which output signals from that selected shift register are transferred to the row conductors as row conductor scanning signals. In the embodiment of FIGS. 2A, 2B and 2C, the row conductor drive circuit comprises three sections. The first of these comprises a shift circuit 8A, including a shift register 14 and associated elements, and a shift circuit 8B, including a shift register 26 and associated elements, and a monitor terminal 41. The second row conductor drive circuit section comprises a shift circuit 10A, comprising shift register 46 etc, a shift circuit 10B comprising a shift register 58 etc, and a monitor terminal 72. The third row conductor drive circuit section comprises a shift circuit 12A comprising a shift register 76 etc, a shift circuit 12B comprising a shift register 79 etc, and a monitor terminal 80. It should be noted that in this description and in the apended claims, the terms "first", "second", . . . as applied to the row conductor drive circuit sections indicate the order of these sections in the row conductor scanning signals sequence, e.g. with a first set of row conductor scanning signals being produced from section 8A, a second set from section 10A, and so on.

In this embodiment, in addition to the above, each row conductor drive circuit section further comprises a set of transmission gates, i.e. electronic switches, for selectively coupling output signals from the shift circuits to, or isolating these signals from, the row conductors, under the control of output signals from the monitor circuits. That is, transmission gates 22*a*, 22*b*, . . . 22*n* control the transfer of signals from shift circuit 8A to a set of n row conductors, Y1, Y2, . . . Yn, while transmission gates 36*a*, 36*b*, . . . 36*n* control the transfer of signals from shift circuit 8B to row conductors Y1, Y2, . . . Yn. Similarly transfer of signals from shift circuit 10A of the second row conductor drive circuit section are controlled by transmission gates 56*a*, 56*b*, . . . 56*n*, and those from shift circuit 10B by transmission gates 70*a*, 70*b*, . . . 70*n*.

Figure 3:
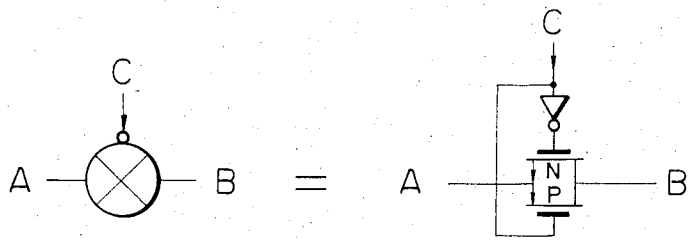
FIG. 3 is a diagram for assistance in describing the operation of an electronic switch element used in the embodiment of FIGS. 2A, 2B and 2C.

Each of these transmission gates has the configuration shown in FIG. 3. When a signal C applied to the control input of a transmission gate is at a low logic level potential (referred to in the following as the L level), then the transmission gate is set in the conducting state, between points A and B, while when the potential of the signal applied to the control terminal is at the high logic level (referred to in the following as the H level), then the transmission gate is set in the non-conducting state between points A and B.

In shift circuit 8A, the outputs Q1, Q2, . . . Qn from shift register 14 are applied to inputs of a corresponding set of NAND gates 20*a*, 20*b*, . . . and an inverter 21 (i.e. only the final shift register stage is coupled to an inverter, the preceding stages all being coupled through NAND gates), which are controlled by the MSK signal from control and timing signal generating circuit 6. A similar set of NAND gates 32*a*,32*b*, . . . and an inverter 34 are also provided in shift circuit 8B. Also in shift circuit 8A, a set/reset flip-flop 18 has the SET input terminal thereof coupled to receive the SET signal from control and timing signal generating circuit 6, has the RESET terminal thereof coupled to the first stage, i.e. Q1, output from shift register 14, and has the Q output thereof coupled to the DATA input terminal of shift register 14. A set/reset flip-flop 30 is similarly arranged in shift circuit 8B. The clock signal $\phi$ is applied though inverters 16 and 28 respectively to the clock input terminals of shift registers 14 and 26 of the first row conductor drive circuit section, and is applied in a similar manner to the shift registers of the other row conductor drive circuit sections.

Monitor terminal 41 is coupled through an inverter 42 to the row conductor which is driven by the final stage shift register outputs of the first row conductor drive circuit. Control terminals 24 and 40 are provided to selectively enable operation of shift circuits 8A and 8B respectively. In this embodiment, control terminals 24 and 40 are the low potential power supply terminals of shift circuits 8A and 8B respectively. When each of these terminals is connected to the L level potential, then the corresponding shift circuit is rendered operative, while when a terminal is connected to the H level potential, the corresponding shift circuit is rendered inoperative. In addition, control terminal 24 is coupled to the control inputs of transmission gates 22*a*, 22*b*, . . . 22*n*, while control terminal 40 is coupled to the control inputs of transmission gates 36*a*, 36*b*, . . . 36*n*. Thus, when control terminal 24 monitor is at the L level and control terminal 40 at the H level, shift circuit 8A is rendered operative while the outputs of NAND gates 20*a*, 20*b*, . . . and inverter 21 are coupled through transmission gates 22*a* to 22*n* to row conductors Y1 to Yn respectively, while shift circuit 8B is rendered inoperative and the outputs of NAND gates 22*n*, 32*b* . . . and inverter 34 are isolated from row conductors Y1 to Yn.

In the second row conductor drive circuit section, shift circuits 10A and 10B are similarly controlled by potentials applied to terminals 57 and 74, while in the third row conductor drive circuit section, shift circuits 12A and 12B are similarly controlled by potentials applied to terminals 77 and 84. However the DATA input terminals of shift registers 46 and 58 in the second row conductor drive circuit section are coupled to the final stage row conductor Yn of the first row conductor drive circuit section, while the DATA input terminals of shift registers 76 and 79 of the third row conductor drive circuit section are coupled to the final stage row conductor of the second row conductor drive circuit section.

In this embodiment, the row conductors perform "active low" logic level control of each of transistors Tr provided at the intersections of the row conductors and column conductors. That is, when the potential applied by a row conductor to the gate electrodes of the corresponding control transistors Tr is at the H level, then the corresponding capacitors C are isolated from the column conductors, while when the potential applied by a row conductor to the gate electrodes of these transistors is at the L level, then the corresponding capacitors C are coupled to the column conductors.

Figure 4:
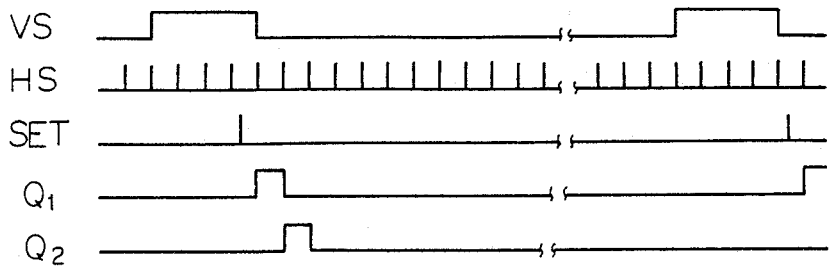
FIG. 4 and FIG. 5 are timing diagrams for describing the operation of the embodiment of FIGS. 2A, 2B and 2C.
Figure 5:
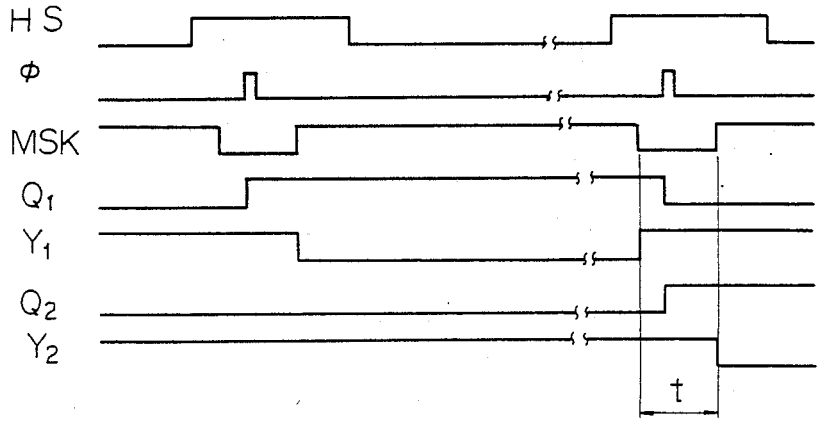

The operation of this embodiment will be described with reference to the timing diagrams of FIG. 4 and FIG. 5. The embodiment is assumed to be part of a television receiver, with scanning of the picture elements being synchronized with a verticaly sync signal VS and a horizontal sync signal HS, derived from a composite video signal. As shown in FIG. 4, pulses of the SET signal are produced in synchronization with the vertical sync signal VS, while as shown in FIG. 5 the pulses of clock signal $\phi$ are synchronized with the horizontal sync signal HS. Initially, (i.e. immediately after power is applied to the circuits), it will be assumed that control terminals 24, 57, 77 are set respectively at the L level, while terminals 40, 74 and 84 are at the H level, so that shift circuits 8A, 10A and 12A are operative and transmission gates 22*a* to 22*n* are in the conducting state, while shift circuits 8B, 10B and 12B are inoperative, and transmission gates 36*a* to 36*n* are in the non-conducting state. When a pulse of the SET signal is output from control and timing signal generating circuit 6, then set/reset flip-flop 18 is set, whereby an H level potential is applied to the DATA input of shift register 14. Outputs Q1, Q2, . . . of shift register 14 thereby successively go the H level, as shown in FIG. 4. When output Q1 goes to the H level, set/reset flip-flop 18 is reset.

If shift register 14 is functioning correctly, then output Qn thereof will subsequently go the the H level. As a result, row conductor Yn will go to the L level, and hence an H level input will be applied from inverter 50 of shift register 46 in the second row conductor drive circuit. Thus, outputs Q1, Q2 . . . of shift register 46 will successively go the the H level, and if shift register 46 is functioning correctly, output Qn thereof will subsequently go to the L level, thereby initiating shifting operation by shift register 76 of the third row conductor drive circuit section. In this way, if all of shift registers 14, 46 and 76 of the first, second and third row conductor drive circuit sections are functioning properly, all of the row conductors will be successively scanned by L level row conductor scanning signals pulses during the interval between two successive SET pulses.

However if, for example, one of more stages of shift register 14 in the first row conductor drive circuit section are defective, then the final stage row conductor Yn of that section will not be driven to the L level by a scanning pulse. Thus, monitor terminal 41 of that section will not go the the H potential. When this is detected, then the potentials applied to control terminals 24 and 40 are inverted, so that shift circuit 8A is made inoperative and transmission gates 22*a*, 22*b*, . . . 22*n* made non-conducting, while shift circuit 8B is set in the operating condition and transmission gates 36*a*, 36*b*, . . . 36*n* are set in the conducting state. Thus, assuming that shift register 26 is functioning properly, the sequence of events described above for shift circuit 8A will be initiated for shift circuit 8B following the next SET signal pulse, so that outputs Q1, Q2, . . . Qn of shift register 26 in the first row conductor drive circuit section will successively go to the H level, thereby successively scanning row conductors Y1 to Yn coupled thereto. Thereafter, successive output of scanning pulses from shift circuit 10A will begin after the final stage Qn of shift register 26 has set the row conductor corresponding thereto to the L level, and in this way all of the row conductors will be successively scanned by output signals from shift circuits 8B, 10A and 12A.

Similarly, if there is any defect in shift register 46, this can be detected and shift circuit 10A set in the inoperative state and shift circuit 10B in the operative state, while if there is a defect in shift register 76, then shift circuit 12A can be set in the inoperative state and shift circuit 12B in the operative state. Thus, so long as at least one of each of the shift registers in each of the row conductor drive circuit sections is functioning properly, then correct scanning operation by the row conductor drive circuit as a whole can be ensured.

The monitoring, and subsequent control terminal voltage setting, can be performed during testing of the display panel after manufacture, by a manual or automated process.

In the above embodiment, monitoring of the operation of the shift registers is performed by detecting whether the row conductor connected to the final shift register stage of a row conductor drive circuit section goes to a predetermined scanning signal potential. However various other means may be envisaged for detecting malfunction of an shift register in a row conductor drive circuit section, other than that used in the present embodiment.

Furthermore in the described embodiment, three row conductor drive circuit sections, each containing two shift registers are utilized. However any desired number of row conductor drive circuit sections can be employed, each containing at least two shift registers, although as the number of row conductor drive circuit sections is increased, the overall amount of circuitry will be accordingly increased, e.g. the number of monitor terminals will increase. It will be apparent that increasing the number of row conductor drive circuit sections, or increasing the number of shift registers in each row conductor drive circuit section, will reduce the possibility of the row conductor drive circuit as a whole (and hence the entire matrix display device) becoming unusable due to malfunctions in two or more shift registers within a single row conductor drive circuit section. However it will also be apparent that even utilizing a comparative small number of row conductor drive circuit sections each including two shift registers will enable a substantial increase to be achieved in the manufacturing yield of a matrix display device incorporating such a row conductor drive circuit formed as an integral portion thereof, by comparison with an arrangement in which only a single shift register (or a pair of shift registers) is used to implement the entire row conductor drive circuit.

In the described embodiment, transmission gates are utilized in order to isolate the outputs from shift circuits which are not currently set in the operative state by the corresponding monitor circuits. Depending upon the particular circuit elements employed, it may be possible to eliminate these transmission gates, or to provide them for only one of the shift registers in each row conductor drive circuit section. However use of the transmission gates has the advantage of isolating the row conductors from stray capacitance, through which induced noise may be coupled to the row conductors.

Although the present invention has been described in the above with reference to a specific embodiment, it should be noted that various changes and modifications to the embodiment may be envisaged, which fall within the scope claimed for the invention as set out in the appended claims. The above specification should therefore be interpreted in a descriptive and not in a limiting sense.

What is claimed is:

1. A row conductor drive circuit for a matrix display device, said matrix display device including a plurality of row conductors and a plurality of column conductors formed on a substrate thereof, said row conductor drive circuit comprising: control and timing signal generating circuit means, and;

at least a first row conductor drive circuit section for successively applying output signals to scan a first set of said row conductors in a fixed sequence and a second row conductor drive circuit section for successively applying output signals to scan a second set of said row conductors, each of said row conductor drive circuit sections comprising first and second shift registers each comprising a plurality of shift register stages, with outputs from corresponding stages of said first and second shift registers in each of said row conductor drive circuit section being coupled in common to respective ones of said row conductors;

each of said row conductor drive circuit section including control means for setting one of said shift registers thereof in an operative condition and the other set of shift registers thereof in an inoperative conditions, and monitor means for detecting defective operation by said shift register thereof which is currently set in the operative condition;

each of said shift registers of said first row conductor drive circuit section being coupled to receive a timing signal from said timing and control signal means for initiating shifting operation thereby, and each of said shift registers of said second row conductor drive circuit section being coupled to a row conductor which is the last to be scanned by said first row conductor drive circuit section in said scanning sequence, for receiving a scanning signal acting to initiate shifting operation thereby.

2. A row conductor drive circuit according to claim 1, in which said monitor means of each of said row conductor drive circuit sections comprises a monitor terminal coupled to the one of said set of row conductors scanned by said row conductor drive circuit section output signals which is scanned last of all in a scanning sequence, with the presence and absence of a drive signal appearing on said monitor terminal serving to respectively indicate normal and defective operation by said shift register currently set in the operative condition.

3. A row conductor drive circuit according to claim 1, and further comprising a plurality of electronic switch elements respectively coupled between said shift register stages and said row conductors, each of said electronic switch elements including a control input which is operable to set said electronic switch element in an open and a closed state, with said control terminals of said electronic switch elements coupled to one of said shift registers being connected in common to said control means of the row conductor drive circuit section containing said shift register such as to isolate said shift register from said row conductors when said shift register is set in the inoperative conditions.

4. A row conductor drive circuit according to claim 1, in which said control means of each of said row conductor drive circuit sections comprises first and second control terminals coupled respectively to control the supply of operating power to said shift registers of said each row conductor drive circuit section.

* * * * *